US005561867A

United States Patent [19]

Roginsky

[11] Patent Number: 5,561,867

[45] Date of Patent: Oct. 8, 1996

[54] SANITARY TOILET SEAT APPARATUS

[76] Inventor: Jacob Roginsky, 11623 Sequoia La., Beltsville, Md. 20705

[21] Appl. No.: 273,172

[22] Filed: Jul. 22, 1994

[51] Int. Cl.[6] ..... A47K 13/14

[52] U.S. Cl. ..... 4/244.2; 4/243.3

[58] Field of Search ..... 4/244.2, 243.3; 242/532.6

[56] References Cited

U.S. PATENT DOCUMENTS

| | | | |
|---|---|---|---|
| 1,037,062 | 8/1912 | Seyl . | |
| 1,071,933 | 9/1913 | Luthi | 4/243.3 |
| 1,163,667 | 12/1915 | Jiranek | 4/244.2 |
| 1,248,216 | 11/1917 | Ward . | |
| 1,954,139 | 4/1934 | Lundin . | |
| 2,693,370 | 11/1954 | Wheatley . | |
| 3,208,684 | 9/1965 | Ramstein | 242/532.6 |
| 4,297,750 | 11/1981 | Lutz . | |
| 5,253,372 | 10/1993 | Boker | 4/242.2 X |

FOREIGN PATENT DOCUMENTS

| | | | |
|---|---|---|---|
| 004800 | 10/1905 | France | 4/244.2 |
| 532094 | 1/1922 | France . | |
| 144440 | 9/1903 | Germany . | |
| 0213746 | 10/1909 | Germany | 4/243.3 |
| 254992 | 4/1912 | Germany . | |
| 0660709 | 6/1938 | Germany | 4/244.2 |
| 0294320 | 4/1936 | Italy | 4/244.2 |
| 193038 | 9/1937 | Switzerland . | |
| 13008 | 4/1919 | United Kingdom . | |

*Primary Examiner*—Charles E. Phillips
*Attorney, Agent, or Firm*—Watson Cole Stevens David, P.L.L.C.

[57] ABSTRACT

An apparatus for providing a protective sheet or substrate on the upper surface of a toilet seat includes a supply storage container disposed at a first end of the toilet seat to store a supply of individual protective sheets, each having an opening, and connected in a continuous fashion. The protective sheet extends across the top of the toilet seat and a take-up container disposed at a second end of the toilet seat opposite to the first end is for taking-up the sheet after use. A mechanism is provided for advancing the sheet and winding it on a shaft.

24 Claims, 1 Drawing Sheet

SANITARY TOILET SEAT APPARATUS

BACKGROUND OF THE INVENTION

1. The field of the Invention

The present invention relates to sanitary toilet seats in general; and in particular, to an apparatus for providing a protective substrate on a seat of a toilet including a supply container and a take-up container disposed at opposite ends of the toilet seat.

2. Description of the Prior Art

As can be seen by reference to the following references; U.S. Pat. Nos. 1,037,062; 1,248,216; 1,954,139; 4,297,750; 5,253,372; GB Patent 13,008; French Patent 532,094; Swedish Patent 193,038; German Patent 144440 and German Patent 245992, sanitary toilet seat arrangements are know in the prior art.

However, the prior art fails to disclose a suitable apparatus for dispensing a protective substrate placed on a seat of a toilet, which may be easily retro-fitted onto conventional toilets, requires minimal space, and is not intrusive to the comfort of the user. The provision of such an apparatus is a stated objective of the present invention.

SUMMARY OF THE INVENTION

An object of the present invention is to provide a sanitary toilet apparatus which overcomes the above-noted deficiencies of the prior art.

Another object of the invention is to provide an apparatus for providing a protective substrate on a seat of a toilet wherein a supply container is provided at a first end of the toilet seat and a take-up container is provided at a second opposite end of the toilet seat.

Accordingly, it is an object of the present invention to introduce an apparatus for providing a protective substrate on a seat of a toilet, the apparatus comprising: a supply storage container, disposed at a first end of the toilet seat, for storing a supply of individual protective substrates connected in a continuous fashion, the supply storage container having a supply aperture formed therein, wherein the individual protective substrates may be pulled through the supply aperture; a take up container, disposed at a second end of the toilet seat opposite to the first end of the toilet seat, for taking-up the individual protective substrates pulled through the supply aperture, the take-up container comprising (i) a housing having a take-up aperture formed therethrough dimensioned to receive the individual protective substrates, and (ii) a rotatable shaft disposed within the housing for receiving and wrapping the individual protective substrates thereabout; and means, operatively associated with the rotatable shaft, for selectively rotating the shaft so as to take-up the individual protective substrates.

Other objects, features and advantages of the present invention are disclosed in the description of the preferred embodiments hereinafter.

DESCRIPTION OF THE PREFERRED EMBODIMENTS

Figure 1:
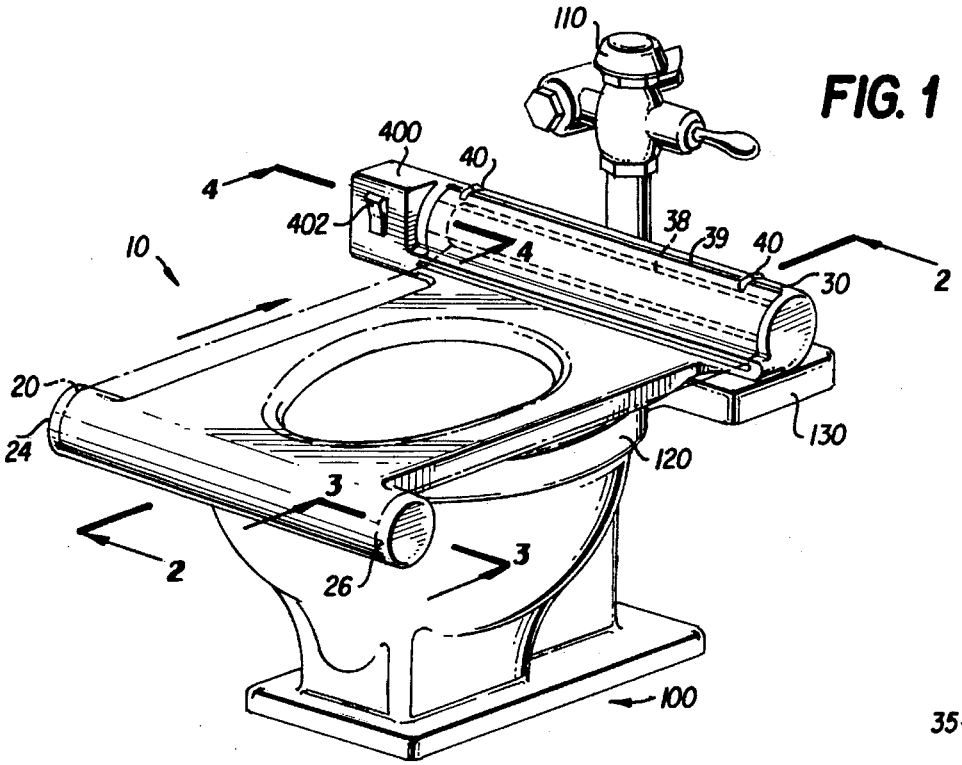
FIG. 1 is a perspective view of the sanitary toilet apparatus of the present invention.

As can be seen by reference to the drawings, and in particular to FIG. 1, the sanitary toilet apparatus of the present invention is designated generally by reference numeral 10.

The apparatus may be used with a conventional toilet 100, having a water supply 110. Although Fig. I illustrates the water supply 110 as pressurized direct valve type, a conventional water closet may be used.

Figure 2:
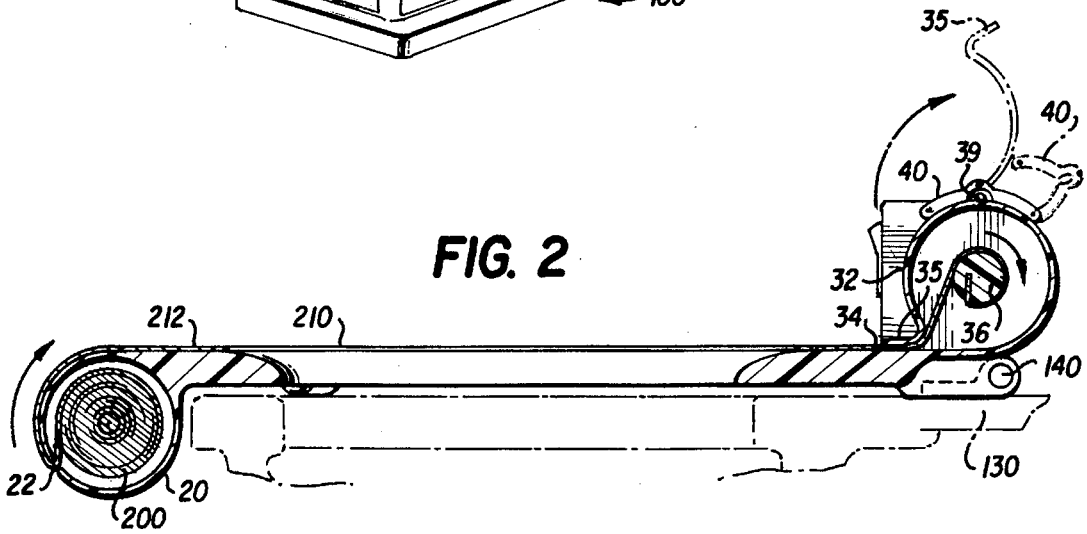
FIG. 2 is a cross-section view taken along line 2—2 of FIG. 1.

Toilet 100 also includes a seat 120 which may be pivotally attached to a base 130 of toilet 100, via a hinge 140 (see FIG. 2).

Figure 3:
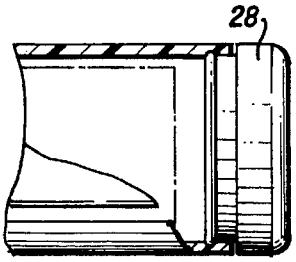
FIG. 3 is a cross-sectional view taken along line 3—3 of FIG. 1.

Referring to FIG. 1, apparatus 10 includes a supply storage container 20. Supply storage container 20 is disposed at a first end of toilet seat 120, and stores a supply 200 of individual protective substrates 210. Protective substrates 210 are connected to one another in a continuous fashion at connection points 212. Each protective substrate 210 is dimensioned to cover toilet seat 120, and includes an aperture formed in its center to be aligned with the center opening of toilet seat 120. Individual protective substrates 210 may be formed of any desirable material such as paper, plastic film, laminates of the desired combination of paper, plastic and metal, etc. Referring to FIG. 2, supply storage container 20 has a supply aperture 22 formed therein. Thus, individual protective substrates 210 may be pulled through supply aperture 22. In one embodiment of the invention, supply storage container 20 is formed integral with seat 120, and is disposed in the front of toilet 100. Alternatively, supply storage container 20 could be substituted by a holder of the type used for kitchen paper towels. That is, two spaced holding elements which support outer ends of supply 200 and have resiliency to allow replacement of the supply. Accordingly, as may be appreciated from FIGS. 1 and 2, supply storage container 20 will be disposed underneath a user's legs, thus avoiding discomfort to the user. In addition, aperture 22 is formed below a plane of seat 120, and protective covers 210 are pulled therethrough, pressed against an outer contour of storage container 20, and slide over seat 120. In a preferred embodiment of the invention, supply storage container 20 is substantially cylindrical, having a first end 24 which is closed, and a second end 26 which is open and dimensioned to receive a reclosable cap 28 (see FIG. 3). Cap 28 may be removed to allow the replacement of supply 200 of protective covers 210. To avoid vandalism, cap 28 may be provided with a desired locking mechanism such as a key lock or combination lock, to prevent unauthorized opening of cap 28. Alternatively, cap 28 may be hinged to container 20.

Figure 5:
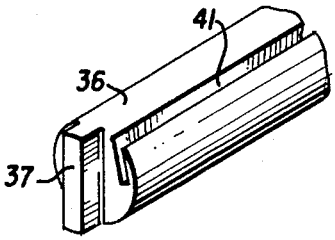
FIG. 5 is a perspective view of the driven end of the take-up shaft.

At the back of toilet seat 120, a take-up container 30 is disposed for taking-up used protective substrates 210 which have been passed over toilet seat 120. Take-up container 30 includes a housing 32 which has an aperture 34 formed therein which is dimensioned to receive individual protective substrates 210. Within housing 30, a rotatable shaft 36 is disposed for receiving and wrapping the individual protective substrates 210 thereabout. Shaft 36 may be a mandrel, or dimensioned to receive a disposable mandrel for collecting substrates 210. As shown in FIG. 2, aperture 34 may be constructed so as to have an upper guide element 35 to maintain substrates 210 pressed against toilet seat 120, even when the radius of used substrates 210 wrapped around shaft 36 increases in size. As shown in FIG. 1, housing 30 is substantially cylindrical having an openable portion 38 on hinge 39 which is held in closed position by over-center toggle mechanism 40 which may be provided with a lock mechanism to prevent vandalism. Openable portion 38 allows the shaft 36 to be selectively removed from housing 30, so as to dispose of used protective substrates 210. The second end 42 of housing 30 is substantially closed, except for a center aperture for receiving an end of shaft 36 (see FIG. 4). As shown in FIG. 5, the shaft end may have a tongue 37 for engagement with a complementary opening in the motor shaft for rotatably driving the shaft 36. The shaft 36 has a longitudinally extending groove 41 (FIGS. 2 & 5) for receiving the leading edge of substrate 210 to secure it thereto so that the substrates will be positively pulled upon rotation of shaft 36. The leading edge may be thickened for easier insertion into grove 41. The grove is preferably non-radial in relation to the circular cross-section of the shaft 36 so that upon reverse rotation after an entire roll of substrates is wound on shaft 36, the leading edge can be easily disengaged from the shaft for more convenient recycling. Alternatively the shaft 36 can be made of the same material (e.g. PVC) as the substrate so both may be recycled.

Figure 4:
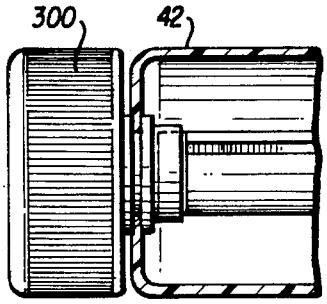
FIG. 4 is a side view of the invention illustrating an alternative embodiment in partial cross-section taken along line 4—4 of FIG. 1.

The apparatus is also provided with a mechanism for rotating shaft 36 through tongue 37 to advance supply 200 of protective substrates 210. As illustrated in FIG. 4, a manual turn knob 300 or a hand crank may be used for this purpose. In such an embodiment, the user merely rotates knob 300 until a new substrate 210 is advanced from supply 200, and is aligned with toilet seat 120.

Alternatively, an automatic mechanism 400 may be provided for advancing supply 200 of substrates 210. As shown in FIG. 1, an electrical motor (e.g. a servo motor) may be connected to drive shaft 36 in response to closing of switch 402. Accordingly, the user would hold button 402 in the ON position until the user visually verifies that a new substrate 210 has been passed over seat 120, and is aligned therewith. Alternatively, mechanism 400 may be constructed so as to automatically align substrates 210 with seat 120. For example, substrates 210 may be provided with a registration mark which may be spotted by an optical eye (not shown). Accordingly, a user would press switch 402 to advance supply 200 of substrates 210, and the motor would continue to drive shaft 36, until an optical eye spots the registration mark, and issues a control signal to the motor to stop advancement of substrate 210. Instead of providing an optical eye and registration marks on substrate 210, each substrate may be provided with a physical registration formation (e.g. a notch formed in the outer periphery of substrate 210). In this case, a mechanical finger would be provided to ride along the outer periphery of substrate 210, and upon detection of the physical registration formation (e.g. a finger is lowered into a recess formed in the side of substrate 210) an electrical circuit would be closed, thus prohibiting advancement of shaft 36.

Furthermore, mechanism 400 need not be an electrically powered device, but may be powered via hydraulics, pneumatics or even by pressurized water. That is, mechanism 400 may be in communication with a water supply to toilet 100. In such an arrangement, the activation of handle 112 to flush toilet 100, may also serve to activate mechanism 400 to advance supply 200 of substrates 210.

Although in the above description the supply storage container 20 is in the front of toilet 100, and take-up container 30 is in the back thereof, this is not required. It is only required that the two containers be disposed at opposite ends of toilet seat 120; thus, their positions may be reversed with respect to that shown in FIG. 1, or one of the containers may be placed on the left side of toilet seat 120, while the other of the containers is placed on the right side of toilet seat 120.

Further, if the toilet seat 120 does not have a closed geometric shape, but rather has a gap formed in the front thereof, two separate substrates 210 may be simultaneously applied to both sides of toilet seats 120. In such an arrangement, instead of having a single supply 200 in container 20, two separate supplies 200 would be used, and similarly two separate take-up rolls would be provided in container 30.

It should be noted that the substrates 210 are preferably dimensioned so as to overhang the edges of seat 120, to protect the user against coming into direct contact with seat 120, if substrate 210 should shift slightly. Further, to prevent shifting of substrate 210, the substrates 210 may provide at outer edges thereof with sequential perforations similar to those provided on continuous feed computer paper. Thus, the take-up shaft 36 would be provided with a traction feed type arrangement, for selectively engaging with such perforations. Such a tractor feed arrangement would serve to take-up substrates 210, and to maintain their alignment with seat 120. In one preferred embodiment, the outer peripheral portion of the film used in such a tractor feed arrangement is made of a stronger material than the remaining portion of substrate 210. It should be noted that if a tractor feed type arrangement is provided, this would allow for the easy calculation of the amount of substrate 210 taking-up, and thus can be used to ensure the alignment of substrate 210 with seat 120.

As may be readily appreciated from the above, the present invention is well suited to be retro-fitted onto a conventional toilet. That is, the device can either be attached to a standard toilet seat, or a new toilet bowl may be formed which includes a seat having supply container 20 and take-up container 30, integrally formed therewith. Alternatively, the entire toilet bowl could be made of molded plastic with the containers 20 and 30 molded therein. A modified toilet seat may be retro-fitted onto a conventional toilet 100. If a new toilet seat is formed having containers 20 and 30 formed integral therewith, the toilet seat may be provided with smooth outer flanges near the front of the toilet seat and the back thereof, to support substrates 210, since the width of substrates 210 is preferably slightly wider than the width of the upper surface of a toilet bowl.

Having thereby described the subject matter of the present invention, it will be apparent that many substitutions, modifications and variations thereof are possible in light of the above teachings.

What is claimed is:

1. An apparatus for providing a protective substrate on a seat of a toilet, said apparatus comprising:

a supply storage container, disposed at a first end of said toilet seat, for storing a supply of individual protective substrates connected in a continuous fashion, said supply storage container having a supply aperture formed therein, wherein said individual protective substrates may be pulled through said supply aperture;

a take up container, disposed at a second end of said toilet seat opposite to said first end of said toilet seat, for taking-up said individual protective substrates pulled through said supply aperture, said take-up container comprising (i) an openable housing having a take-up aperture formed therethrough dimensioned to receive said individual protective substrates, (ii) a rotatable shaft disposed within said housing for receiving and wrapping said individual protective substrates thereabout; and rotating means, operatively connected only to said rotatable shaft, for selectively rotating said shaft so as to take-up said individual protective substrates; said rotatable shaft having means for disconnection from said rotating means and a longitudinally extending slit to receive a leading edge of a sheet of said substrates, said slit being non-radial in relation to a cross-section of said rotatable shaft so that said shaft, when loaded with a roll of protective substrates wound therearound, can be removed from said housing and the shaft slid axially out of said roll for re-use of said shaft.

2. An apparatus according to claim 1, wherein said supply storage container is disposed at a front of said toilet and said take-up container is disposed at a back of said toilet.

3. An apparatus according to claim 1, wherein said rotating means comprises a manually operated device.

4. An apparatus according to claim 1, wherein said rotating means comprises an electric motor.

5. An apparatus according to claim 4, wherein said electric motor is a servo motor.

6. An apparatus according to claim 1, wherein said rotating means comprises a pneumatic system.

7. An apparatus according to claim 1, wherein said rotating means comprises a pressurized water system.

8. An apparatus according to claim 1, wherein said supply storage container is disposed at a back of said toilet and said take-up container is disposed at a front of said toilet.

9. An apparatus according to claim 1, wherein said individual protective substrates are formed of a sheet material comprising at least one of plastic and paper.

10. An apparatus according to claim 1, wherein said individual protective substrates are formed of paper.

11. An apparatus according to claim 1, wherein said individual protective substrates are formed of a laminate of plastic and paper.

12. An apparatus according to claim 11, wherein said laminate further comprises metal.

13. An apparatus according to claim 1, wherein said means is manually operated until a user confirms registration of one of said individual protective substrates with said toilet seat.

14. An apparatus according to claim 1 wherein said openable housing on the take-up container has a generally "U" shaped hinged cover with an edge shaped to bear against a top surface of said protective substrate so as to keep said substrate in position against an upper surface of said toilet seat.

15. An apparatus according to claim 1, wherein said rotating means comprises drive means for rotating said shaft, and detecting means for detecting registration of one of said individual protective substrates with said toilet seat and for controlling said drive means in response thereto.

16. An apparatus according to claim 15, wherein said individual protective substrates are provided with registration marks, and said detecting means comprises an optical system for detecting said registration marks.

17. An apparatus according to claim 15, wherein said individual protective substrates are provided with physical registration formations, and said detecting means comprises a mechanical member for detecting said physical registration formations.

18. An apparatus according to claim 17, wherein said physical registration formations comprises notches formed in peripheries of said individual protective substrates and said mechanical member comprises a mechanical finger.

19. A toilet seat according to claim 18, wherein said rotating means comprises a motor.

20. A toilet seat according to claim 18, wherein said rotating means comprises a manual knob.

21. An apparatus according to claim 15, wherein said individual protective substrates are provided with a series of perforations for tractor feed of the substrate into the take-up container.

22. An apparatus according to claim 1 wherein said supply storage container is of general cylindrical shape having an openable cap at one end for insertion of a supply of said protective substrates.

23. An apparatus according to claim 2 wherein said supply aperture is positioned to face downwardly from said supply storage container so that the front edge of the supply storage container, which would come in use come into contact with the back of a user's legs, is covered by a portion of a protective substrate.

24. A sanitary toilet seat comprising:

a seat portion having an aperture formed therethrough;

a supply storage container of general cylindrical shape having an openable cap at one end, integrally connected to a front end of said seat portion, for storing a supply of individual protective substrates connected in a continuous fashion, said supply storage container having a supply aperture formed therein, said supply aperture facing downwardly so that a front edge of the supply storage container, which would in use come into contact with the back of a user's legs, is covered by a portion of a protective substrate, wherein said individual protective substrates may be pulled through said supply aperture;

a take up container, integrally connected to a back end of said seat portion opposite to said front end of said seat portion, for taking-up said individual protective substrates pulled through said supply aperture, said take-up container comprising (i) an openable housing having a take-up aperture formed therethrough dimensioned to receive said individual protective substrates, and (ii) a rotatable shaft disposed within said housing for receiving and wrapping said individual protective substrates thereabout; and rotating means, operatively connected only to said rotatable shaft, for selectively rotating said shaft so as to take,up said individual protective substrates; said rotatable shaft having means for disconnection from said rotating means and a longitudinally extending slit to receive a leading edge of a sheet of said substrates, said slit being non-radial in relation to a cross-section of said rotatable shaft so that said shaft, when loaded with a roll of protective substances wound therearound, can be removed from said housing and the shaft slid axially out of said roll for re-use of said shaft.

* * * * *